US006588061B2

(12) United States Patent
Becken

(10) Patent No.: US 6,588,061 B2
(45) Date of Patent: Jul. 8, 2003

(54) ENHANCED PERFORMANCE TANDEM ROLLER FOR PATIO DOORS

(75) Inventor: Donald A. Becken, Burbank, CA (US)

(73) Assignee: Truth Hardware Corporation, Owatonna, MN (US)

( * ) Notice: Subject to any disclaimer, the term of this patent is extended or adjusted under 35 U.S.C. 154(b) by 18 days.

(21) Appl. No.: 09/865,819

(22) Filed: May 25, 2001

(65) Prior Publication Data

US 2001/0053736 A1 Dec. 20, 2001

Related U.S. Application Data

(60) Provisional application No. 60/211,668, filed on Jun. 15, 2000.

(51) Int. Cl.[7] ..... E05D 13/00
(52) U.S. Cl. ..... 16/105
(58) Field of Search ..... 16/105, 103, 34; 49/425, 452

(56) References Cited

U.S. PATENT DOCUMENTS 3,040,391 A * 6/1962 Saunders ..... 16/105
3,670,357 A * 6/1972 Steigerwald ..... 16/100
3,827,104 A * 8/1974 Lambertz ..... 16/105
4,030,160 A * 6/1977 Lambertz et al. ..... 16/105
4,102,009 A * 7/1978 Kelly ..... 16/100
4,189,870 A * 2/1980 Helmick ..... 16/105
4,253,278 A * 3/1981 Dallaire ..... 16/105
4,262,451 A * 4/1981 Dallaire ..... 16/105
4,282,631 A * 8/1981 Uehara et al. ..... 16/102
4,353,186 A * 10/1982 Offterdinger ..... 16/105
4,633,615 A * 1/1987 Moose ..... 16/100
4,783,879 A * 11/1988 Weaver ..... 16/19
5,546,706 A * 8/1996 Coupet ..... 16/105

* cited by examiner

*Primary Examiner*—Thomas B. Will
*Assistant Examiner*—Alexandra K. Pechhold
(74) *Attorney, Agent, or Firm*—Lorusso Loud & Kelly LLP

(57) ABSTRACT

A pop-in extended travel single roller for patio doors is retained in the patio door track by no mechanical device. This is accomplished by mounting the roller assembly into a pre-fabricated opening, the width of which is slightly larger than the over-all basic width of the outer housing. Protrusions on the side of the outer housing, after passing through the opening, retain the roller in the proper position. This feature eliminates the need for mechanical fasteners thereby saving costs of parts and labor. This assembly also provides for increased over-all height adjustment range aids the ease of removal of the movable panel of the patio door assembly through the use of an adjusting screw.

4 Claims, 4 Drawing Sheets

ENHANCED PERFORMANCE TANDEM ROLLER FOR PATIO DOORS

CROSS-REFERENCE TO RELATED APPLICATIONS

A claim of benefit is made to provisional application No. 60/211,668 filed on Jun. 15, 2000, which is herein incorporated by reference.

BACKGROUND OF THE INVENTION

1. Field of the Invention

The present invention relates generally to roller wheel assemblies for patio doors, and more particularly to the improvements in the roller wheel assemblies for such doors that allow for increased over-all height adjustments and that do not require mechanical fasteners to mount the roller assembly. It will be appreciated, however, that the roller or wheel assembly could have many uses but it has been specifically designed for rolling or sliding patio doors.

2. Description of the Prior Art

Sliding patio doors of the kind referred to are well known and comprise a rectangular metal frame to be fixed within a door opening in a wall and at least a pair of relatively movable door panels mounted within the frame. One of these panels is generally a fixed panel that is securely fastened to the frame and occupies only a portion of the frame opening so that the remainder of the frame opening provides an access opening through the frame. The other panel of the door assembly is a movable panel that overlaps the stationary panel. The movable door panel is supported at its bottom on a track extending along the bottom of the door frame by means of roller assemblies mounted within a downwardly opening channel along the lower edge of the door panel. Each roller assembly has a peripherally grooved roller that rides in the track and is supported for vertical floating movement on a mounting bracket that is fixed within the bottom door channel.

While there is an assortment of sliding door arrangements for mounting door rollers to rest on and travel along tracks, and several thereof that show arrangements for discouraging lifting of the sliding door out of the track, none, however, show a roller assembly that does not require some type of mechanical fastener(s) to mount the roller assembly to the door frame or rail. Whereby, a simple and reliable roller assembly that allows for the mounting of such assembly without mechanical fasteners is provided by this invention. The present invention also seeks to provide an increased over-all height adjustment range by means of an adjustment to the assembly.

SUMMARY OF THE INVENTION

Accordingly, it is an object of the present invention to provide a roller assembly that requires no mechanical fasteners to mount the roller.

Another object of the present invention is to provide a roller assembly that provides for an increased over-all height adjustment range of up to one inch nominally. Still another object of the present invention is to provide an easier way to remove the movable panel of the door assembly.

In accordance with the present invention, a pop-in extended travel single roller assembly includes an outer housing assembly with an outer housing, an inner housing assembly with an inner housing, a grooved roller wheel, a (wheel) rivet, a pivot pin, and an adjusting screw and nut. In the wheel full-up position, the adjusting screw is fully retracted in the adjusting screw nut and the push contact point of the push contact in the inner housing assembly is in contact with the end of the adjusting screw. In this full-up position, the inner housing assembly is prevented from dropping out of the position by means of a holding feature between the outer surface of the inner housing and the inner surface of the outer housing. This feature aids in the ease of removal of the movable panel of the door assembly. To adjust the wheel downward, the adjusting screw is turned clockwise and pressure is applied to the push contact point on the push contact forcing the inner housing assembly to rotate about the pivot point until the desired roller adjustment is achieved. This can provide an increased over-all height adjustment range up to 1 inch nominal. Mounting of the roller is achieved by inserting the roller into a prefabricated opening, the width of which is slightly larger than the over-all basic width of the outer housing. Protrusions on the side of the outer housing, after passing through the opening, retain the roller in the proper position. This feature eliminates the need for mechanical fasteners thus saving the cost of parts and labor.

Other objects and advantages of the present invention will become more obvious hereinafter in the specification and drawings disclosing what are presently contemplated as being the best mode of the invention.

BRIEF DESCRIPTION OF THE DRAWING

A more complete understanding of the invention and many of the attendant advantages thereto will be readily appreciated as the same becomes better understood by reference to the following detailed description when considered in conjunction with the accompanying drawing wherein like reference numerals refer to like parts and wherein.

DESCRIPTION OF THE PREFERRED EMBODIMENT

Figure 1:
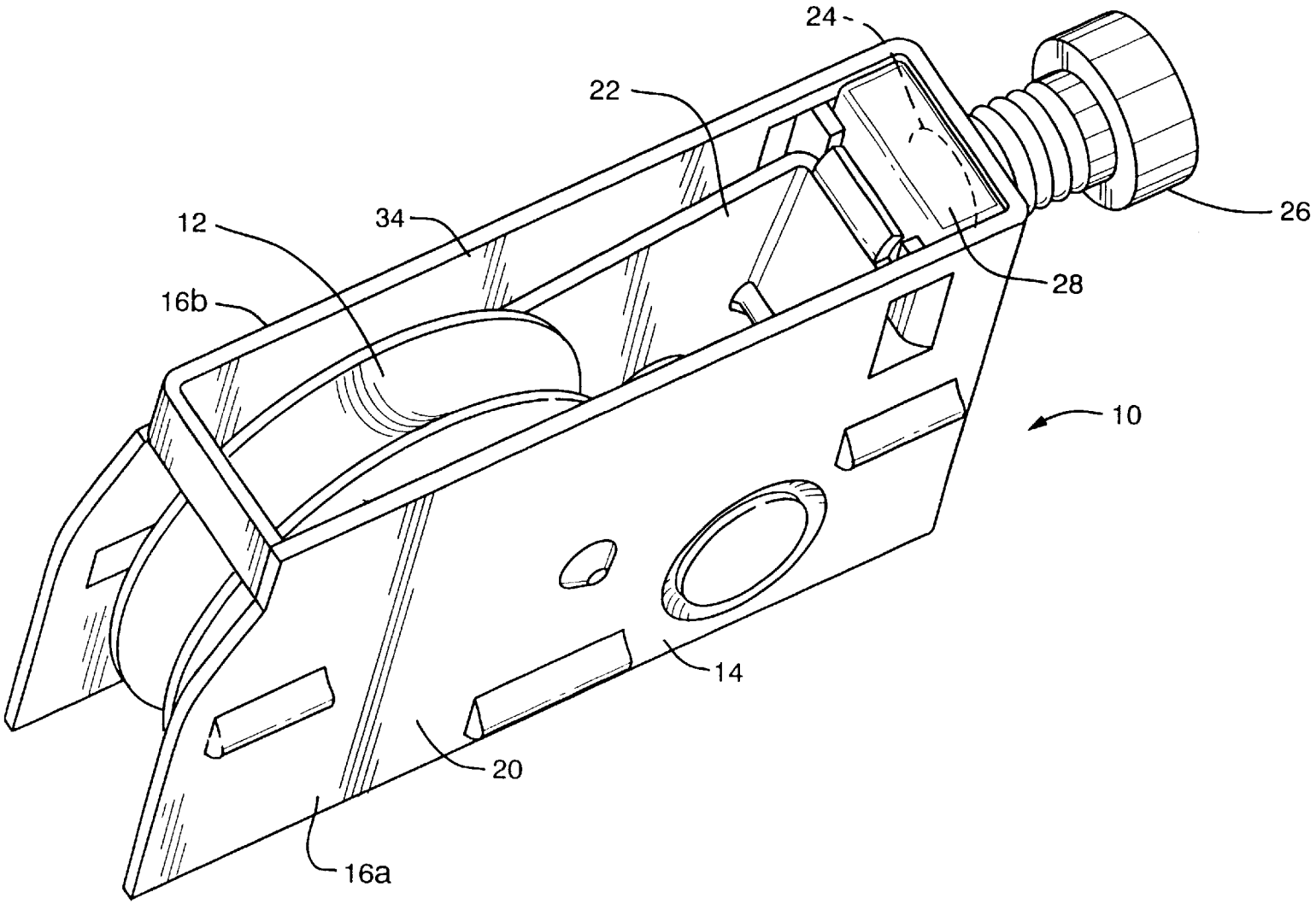
FIG. 1 is a perspective view of the pop-in extended travel single roller assembly in accordance to the present invention.

Referring now to FIG. 1, there is shown a pop-in extended travel single roller assembly for patio doors. FIG. 1 shows the single wheel roller assembly 10 comprising a single grooved roller wheel 12. The roller wheel 12 is received between the opposed, open parallel legs of a U-shaped carrier member 14. The U-shape of the U-shaped carrier member 14 is located on one end and at the other opposite end, the end that is open, the roller wheel 12 is retained. The roller wheel 12 is in an axially spaced relation between the opposed legs 16*a*, 16*b* and is rotatively secured by a respective rivet pin 18. The rivet pin 18 can be seen in FIG. 2. The U-shaped carrier member 14 has an outer housing 20 and an inner housing 22.

Figure 2:
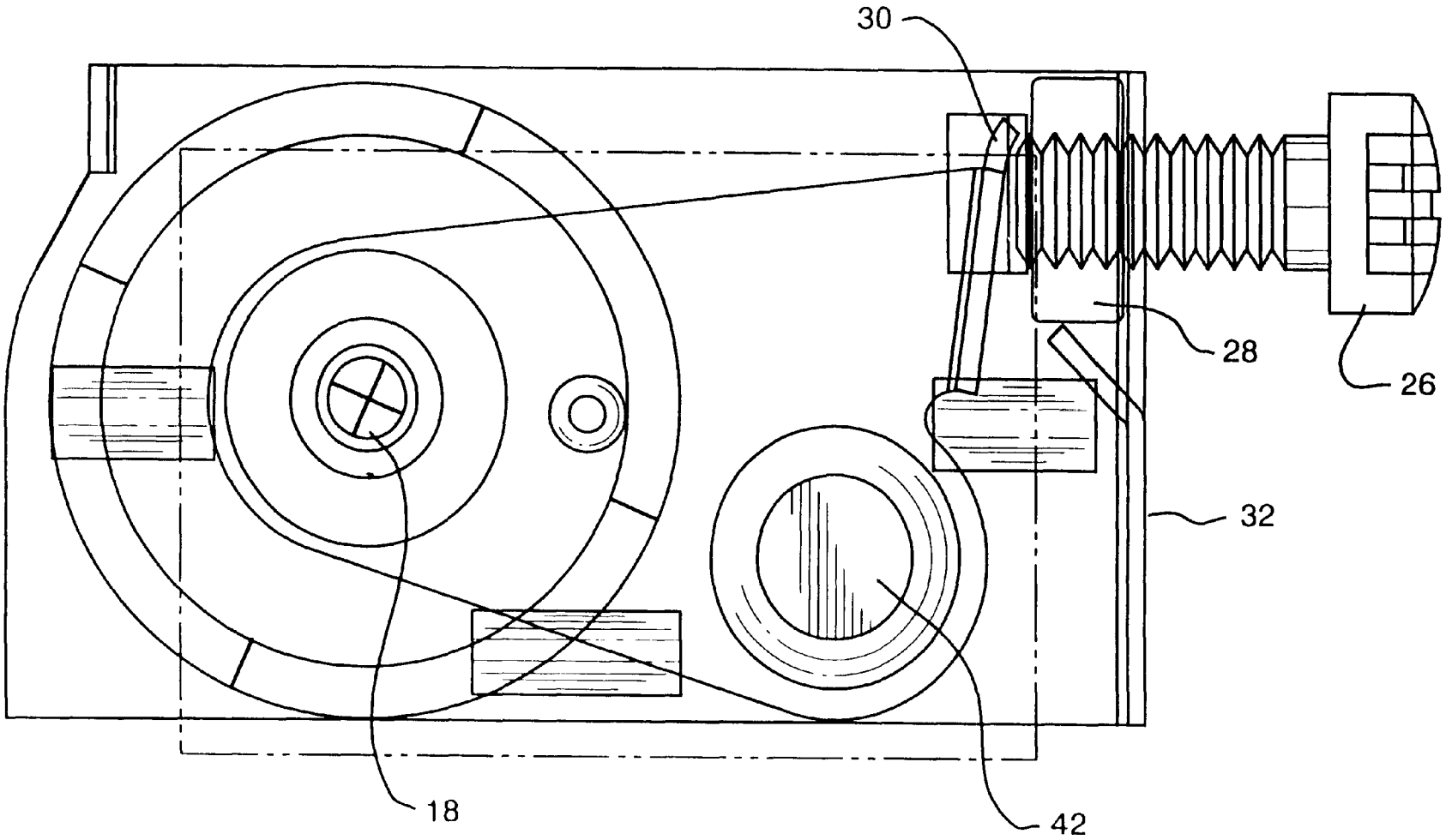
FIG. 2 is a side view of the roller assembly as shown in FIG. 1 with the roller wheel in the horizontal or up position.
Figure 3:
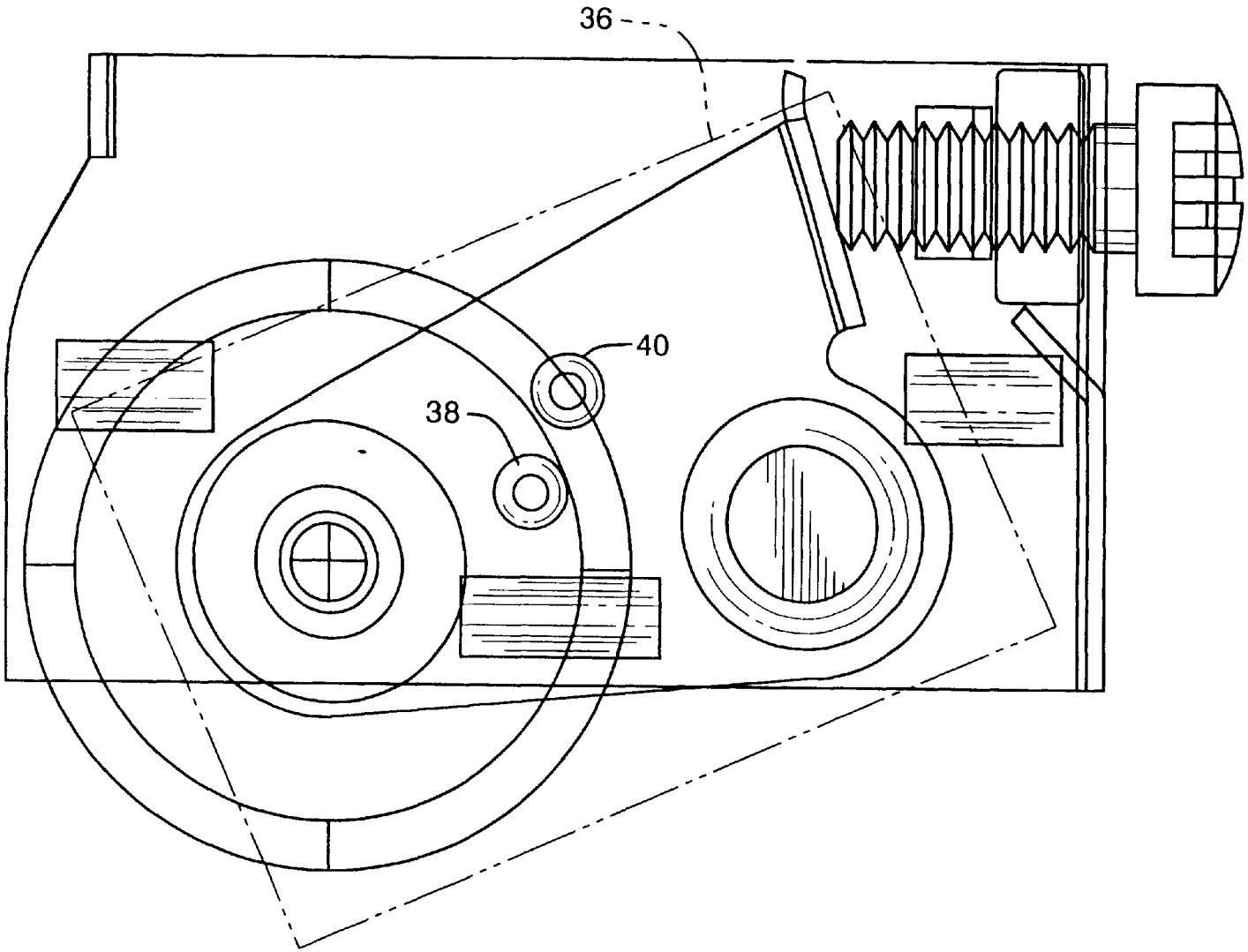
FIG. 3 is a side view of the roller assembly as shown in FIG. 1 with the roller wheel in the vertical or down position.

Means is provided for adjustably raising the height of the carrier member 14. For this purpose, the closed end of the U-shape of member 14 is provided with a circular opening 24 through which an adjusting machine screw 26 extends. Circular opening 24 is threaded during fabrication so that it forms an adjusting screw nut 28 in which machine screw 26 extends through for inter-threading reception. In operation, it will be understood that as machine screw 26 is screwed into the screw nut 28, the U-shaped carrier member 14, together with the roller wheel 12, assembled thereto, will be adjusted in height. FIG. 2 shows the roller assembly 10 in the full-up position whereas FIG. 3 shows the roller assembly 10 with the roller wheel 12 in the full-down position. In the wheel full-up position, the adjusting screw 26 is fully retracted in the adjusting screw nut 28 and the push contact point 30 of the push contact 32 of the inner housing assembly 34 is in contact with the end of the adjusting screw 26.

In this full-up position, the inner housing assembly 34 is prevented from dropping out of position by means of a holding feature 36 between the outer surface of the inner housing 22 of the inner housing assembly 34 and the inner surface of the outer housing 20 of the outer housing assembly 34. The holding feature 36 consists of a male or a bump 38 and female or detent 40 and can be seen in FIG. 3. This feature aids in the ease of removal of the movable panel of the door assembly.

Figure 4:
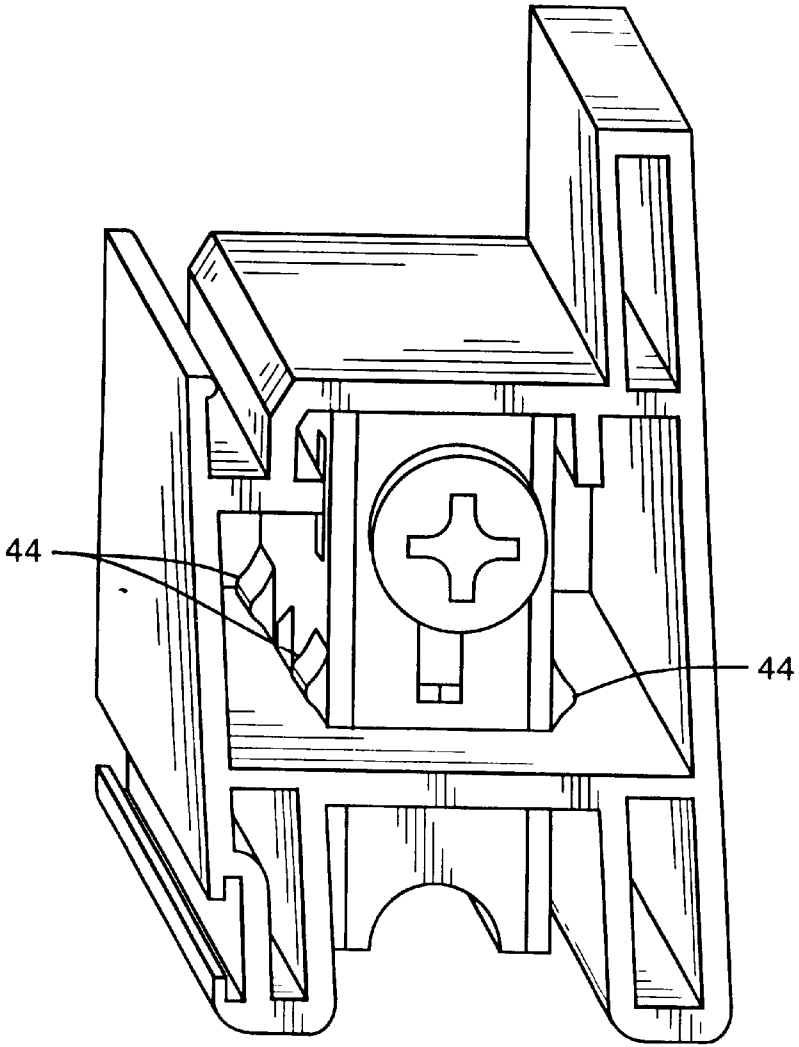
FIG. 4 is an end elevation view of a track of a sliding patio door, with the roller assembly being held in place by the protrusions on the side of the outer housing of the roller assembly.

To adjust the wheel 12 downward, the adjusting screw 26 is turned clockwise thereby causing pressure to be applied to the push contact point 30 of the push contact 32 forcing the inner housing 22 to rotate about the pivot point 42 until the desired roller adjustment is achieved. Finally, in FIGS. 2 and 4, mounting of the roller assembly 10 is achieved by inserting the roller assembly 10 into a pre-fabricated opening, the width of which is slightly larger than the over-all basic width of the outer housing 20. Protrusions 44 on the side of the outer housing 20, after passing through the opening, retain the roller assembly 10 in the proper position. This feature eliminates the need for mechanical fasteners thus saving the cost of parts and labor.

The roller assembly just described is mounted into the frame or rail of a patio door without the use of mechanical fasteners. Furthermore, this assembly aids in the ease of removal of the movable panel of the door assembly. Finally, with the insertion of the roller assembly during the pre-fabrication stage the protrusions on the roller assembly retain the roller in the proper position, thereby, eliminating the need for mechanical fasteners.

Although the present invention has been described relative to a specific embodiment thereof, it is not so limited. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A pop-in extended travel single roller assembly comprising:

an outer housing;

an inner housing pivotally mounted within the outer housing, wherein the inner housing is a triangular shape having an apex and a base, the base having a first base corner and a second base corner;

a single grooved roller wheel rotatably mounted at the apex of the inner housing; and an adjustment mechanism to pivot the inner housing inside the outer housing causing vertical movement of the wheel, wherein the adjustment mechanism is a threaded shaft having a head capable of receiving a rotational force;

wherein the outer housing further comprises a threaded hole to receive the threaded shaft, wherein the hole is positioned to direct the threaded shaft to contact the inner housing; and wherein the inner housing further comprises a push contact mounted in the first base corner and a pin mounted in the second base corner, wherein the push contact is in cooperative contact with the threaded shaft to displace the wheel, and wherein the mounting of the pin maximizes the effect of the threaded shaft upon displacement of the wheel.

2. A pop-in extended travel single roller assembly comprising:

an outer housing;

an inner housing pivotally mounted within the outer housing, wherein the inner housing is a triangular shape having an apex and a base, the base having a first base corner and a second base corner;

a single grooved roller wheel rotatably mounted at the apex of the inner housing;

an adjustment mechanism to pivot the inner housing inside the outer housing causing vertical movement of the wheel, wherein the adjustment mechanism is a threaded shaft having a head capable of receiving a rotational force; and a bump and a detent mounted on the inner housing and the outer housing, wherein the bump and the detent act in cooperation to retain the wheel within the outer housing;

wherein the outer housing further comprises a threaded hole to receive the threaded shaft, wherein the hole is positioned to direct the threaded shaft to contact the inner housing; and wherein the inner housing further comprises a push contact mounted in the first base corner and a pin mounted in the second base corner, wherein the push contact is in cooperative contact with the threaded shaft to displace the wheel, and wherein the mounting of the pin maximizes the effect of the threaded shaft upon displacement of the wheel.

3. A pop-in extended travel single roller assembly and sliding frame assembly comprising:

a sliding frame having an opening designed to receive the pop-in extended travel single roller assembly which comprises;

an outer housing having protrusions, wherein the outer housing fits within the opening in the sliding frame, and wherein the protrusions prevent exit of the outer housing from the opening;

an inner housing pivotally mounted within the outer housing, wherein the inner housing is a triangular shape having an apex and a base, the base having a first base corner and a second base corner;

a single grooved roller wheel rotatably mounted at the apex of the inner housing; and an adjustment mechanism to pivot the inner housing inside the outer housing causing vertical movement of the wheel, wherein the adjustment mechanism is a threaded shaft having a head capable of receiving a rotational force;

wherein the outer housing further comprises a threaded hole to receive the threaded shaft, wherein the hole is positioned to direct the threaded shaft to contact the inner housing; and wherein the inner housing further comprises a push contact mounted in the first base corner and a pin mounted in the second base corner, wherein the push contact is in cooperative contact with the threaded shaft to displace the wheel, and wherein the mounting of the pin maximizes the effect of the threaded shaft upon displacement of the wheel.

4. The roller assembly of claim 3 further comprising a bump and a detent mounted on the inner housing and the outer housing, wherein the bump and the detent act in cooperation to retain the wheel within the outer housing.

* * * * *